US012553604B2

(12) United States Patent
Tuttle

(10) Patent No.: US 12,553,604 B2
(45) Date of Patent: Feb. 17, 2026

(54) SWIRLING FLOW-BLURRING ATOMIZER

(71) Applicant: The Government of the United States of America, as represented by the Secretary of the Navy, Arlington, VA (US)

(72) Inventor: Steven G Tuttle, Brandywine, MD (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 412 days.

(21) Appl. No.: 17/343,846

(22) Filed: Jun. 10, 2021

(65) Prior Publication Data

US 2022/0397267 A1 Dec. 15, 2022

(51) Int. Cl.

| | |
|---|---|
| ***F23D 11/10*** | (2006.01) |
| ***F23R 3/30*** | (2006.01) |
| *F23R 3/14* | (2006.01) |

(52) U.S. Cl.

CPC ..... *F23D 11/107* (2013.01); *F23R 3/30* (2013.01); *F23N 2237/14* (2020.01); *F23R 3/14* (2013.01)

(58) Field of Classification Search

CPC ..... F23R 3/30; F23R 3/32; F23R 3/14; F01D 11/107

See application file for complete search history.

(56) References Cited

U.S. PATENT DOCUMENTS

| | | | | |
|---|---|---|---|---|
| 3,917,173 | A * | 11/1975 | Singh | F23D 11/107 239/404 |
| 2007/0157617 | A1* | 7/2007 | von der Bank | F23R 3/343 60/743 |
| 2018/0306437 | A1* | 10/2018 | Gunderson | F23R 3/002 |
| 2019/0170354 | A1* | 6/2019 | Resvanis | F23R 3/16 |
| 2021/0025594 | A1* | 1/2021 | Hiromitsu | F23R 3/28 |
| 2021/0172604 | A1* | 6/2021 | Locke | F23R 3/286 |

* cited by examiner

*Primary Examiner* — Katheryn A Malatek

(74) *Attorney, Agent, or Firm* — US Naval Research Laboratory; William P. Ladd

(57) ABSTRACT

An atomizer includes an endcap having a nozzle; an annular sidewall extending outward from a surface of the endcap and situated radially outward from the nozzle; and a plurality of vanes extending radially inward from the sidewall and axially outward from the endcap, the vanes being set at a non-zero angle of incidence to the sidewall. The annular sidewall and endcap define an fluid chamber between an inlet and the nozzle, and flow from the inlet to the nozzle is at least partially directed through passageways between the vanes, and the flow is imparted with swirling motion from the vanes.

16 Claims, 1 Drawing Sheet

SWIRLING FLOW-BLURRING ATOMIZER

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, D.C. 20375, USA; +1.202.767.7230; techtran@nrl.navy.mil, referencing NC 107170.

FIELD OF INVENTION

The present invention relates generally to atomizers, and more particularly to a swirling flow-blurring atomizer.

BACKGROUND

Conventional gas turbine engines are currently being developed that will allow greater range, flight duration, and available power for electronic payloads, but their operability can be compromised by the available fuel quality in regions since they are designed for single-fuel operation. Fuels laced with impurities, poor distillation quality control, higher-cut, or high viscosity fuels such as plant-derived fuels may be more readily available than jet fuel, kerosene, or diesel in remote regions of the world. Power systems with engines capable of operating on lower quality fuels can remain operational while utilizing the local fuel supply. Designers typically optimize gas turbine fuel injectors to operate with kerosene-based jet fuels, such as Jet A, JP-5, or JP-8. These engines use conventional fuel injectors, such as pressure, air-assisted, or air-blast atomizers, in conjunction with swirl-stabilized or similar recirculation zone-stabilized burners. Pressure atomizers require heavy, high-pressure pumps and small exit diameters. Air-assisted atomizers require a portion of compressor air while air-blast atomizers require a secondary, high-pressure source of air to atomize fuel. Both utilize narrow, circuitous fuel injection routes to distribute liquid fuel to locations where high local shear stress between the air and fuel atomizes the fuel. Narrow flow passageways are incapable of accommodating highly viscous residual fuels and fuel-born particles found in low quality fuel without clogging.

Conventional flow-blurring atomizers are capable of atomizing a wide range of both high and low viscosity fuels while delivering a consistently fine droplet distribution. Though similar to a flow-focusing or air-blast atomizer, the fuel delivery is placed close to the exit to produce a high-shear region where the atomizing air flows radially inward and then must turn sharply to exit. In the process, local shear forms and stretches thin ligaments as air travels out of the nozzle. Surface tension breaks apart the ligaments into droplets to produce primary atomization. A key advantage of the flow-blurring atomizer is the low pressure requirement for both fuel and air.

Though the multi-fuel capability of the flow-blurring atomizer makes it a design candidate for multi-fuel engines, it produces a narrow, solid spray plume that is suited more to diesel engines than gas turbine engines. In the swirl-stabilized burners used in aircraft, industrial, and marine gas turbines, solid, conical spray plumes are shown to produce lifted flames that are susceptible to acoustic coupling because their anchoring behavior is coupled to the pressure drop across the swirler. To avoid lifted swirl flames, gas turbine combustors typically use hollow spray plumes in the center of a jet of swirling air.

SUMMARY OF INVENTION

Therefore, described herein is a device for producing a wider spray plume than can be produced by a conventional flow-blurring atomizer (FBA) with the same supply pressures and flow rates of the atomizing gas and liquid. The tangential momentum imposed by the swirl also increases the turbulent mixing between the plume and the surrounding air. This change assists in broadening the spray plume droplets to a wider region and in the formation and anchoring of stable combustion.

According to one aspect of the invention, an atomizer configured to atomize liquids passed therethrough includes an endcap having a nozzle situated therein; an annular sidewall extending axially outward from a surface of the endcap and situated radially outward from the nozzle; and a plurality of vanes extending radially inward from any location along the sidewall as well as axially outward from the endcap, the vanes being set at a non-zero angle of incidence to the sidewall. The annular sidewall and endcap define an inner fluid chamber between a fluid inlet and the nozzle, and wherein flow from the inlet to the nozzle is at least partially directed through passageways between the plurality of vanes, and wherein the flow is imparted with swirling motion from the plurality of vanes.

Optionally, the nozzle is centered with respect to the annular sidewall.

Optionally, the vanes are connected to an inner surface of the annular sidewall.

Optionally, the vanes are connected to the surface of the endcap.

Optionally, the angle of incidence is 32 degrees.

The foregoing and other features of the invention are hereinafter described in greater detail with reference to the accompanying drawings.

DETAILED DESCRIPTION

To produce a wider, hollower plume than conventional atomizers, swirl vanes can be added to impart tangential momentum to the atomizing air at any location upstream of the liquid injection to increase rotation as it approaches the exit orifice, which propels droplets outward from the plume center to form a broader, more hollow, conical spray plume that will prevent flame lifting and the associated combustion dynamics. Preliminary demonstrations with 30° swirl vanes have shown to produce broader plumes with better mixing behavior than the strait atomizer.

Figure 1:
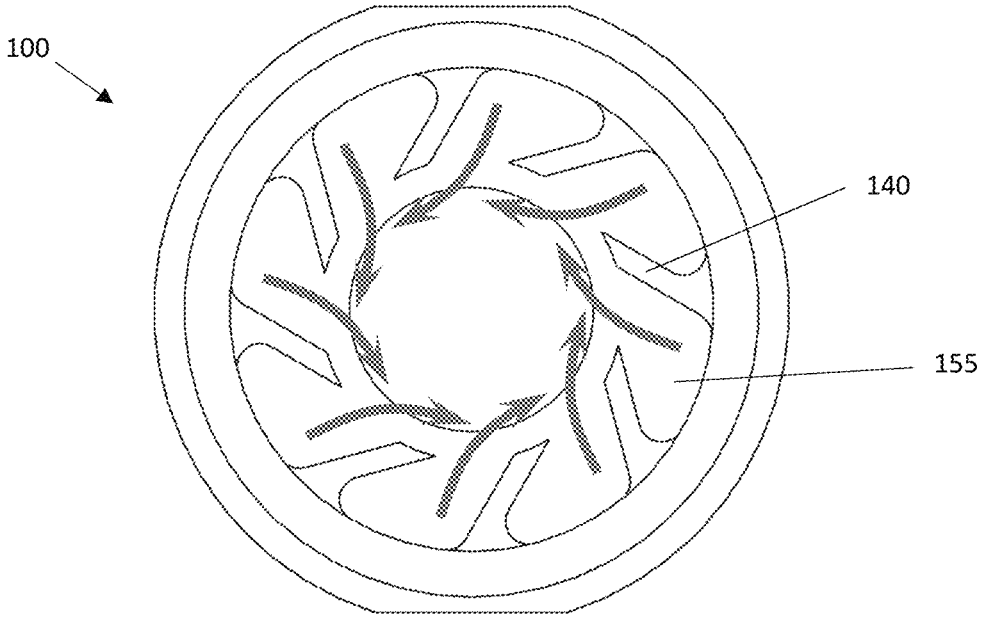
FIG. 1 shows a bottom view of an exemplary atomizer showing the swirl vanes extending into the stream of gas.
Figure 2:
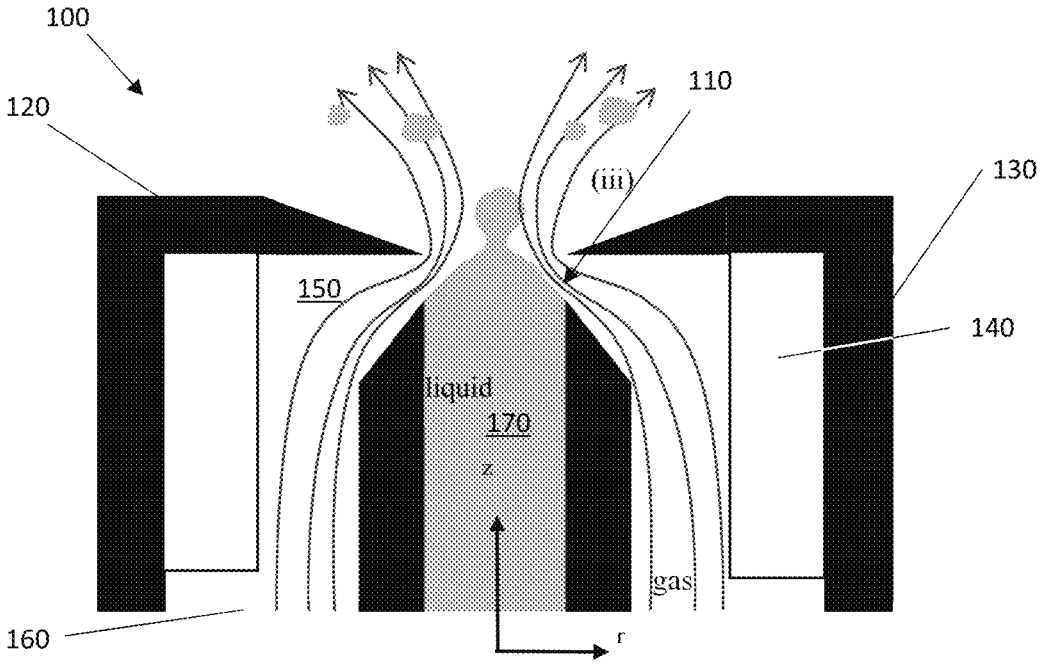
FIG. 2 shows a cross-sectional schematic view of an exemplary atomizer showing swirl vanes extending into the stream of gas.

Referring first to FIGS. 1 and 2, an exemplary atomizer 100 includes a spray nozzle 110 configured to atomize liquids passed therethrough. The spray nozzle is situated in an endcap 120, preferably in the center of the endcap. An annular sidewall 130 extends axially outward from the inner surface of the endcap, and is situated radially outward from the nozzle, circumscribing it. A plurality of vanes 140 extend radially inward from the sidewall 130 and axially outward from the endcap 120. The vanes are set at a non-zero angle of incidence to the sidewall. An exemplary embodiment has 8 swirl vanes 140. The annular sidewall 130 and endcap 120 define an inner fluid chamber 150 between a fluid inlet 160 and the nozzle 110. Fluid (preferably gas) flow from the inlet to the nozzle is at least partially directed through passageways 155 between the plurality of vanes 140, and the gaseous flow is, therefore, imparted with swirling motion from the plurality of vanes 140. A central tube 170 carries fuel or other fluid to a point adjacent the nozzle 11, where it is mixed with the flow of gas and atomized.

Nozzle tests have been performed with water and air to determine the spray behavior of exemplary atomizer tips, as shown in FIGS. 1 and 2. The relevant parameters for these tests are the air flow rate, liquid flow rate, and the mass-based air-liquid ratio (ALR), which is a ratio of the mass flow of the air to the mass flow of the liquid.

Plume tests reveal that a conventional nozzle produces a plume spreading angle of 22°, while an exemplary nozzle with 30° radial swirl vanes produces a plume with a spread of 32°, resulting in a 31% increase.

The tangential momentum imposed by the swirl vanes produces a substantial increase in the plume angle that allow exemplary atomizers to be utilized for any application that requires a broader spray cone, such as, for example, spray burners, coating applications, fire suppression, and water-efficient spray washing.

The tangential momentum imposed by the swirl also increases the turbulent mixing between the plume and the surrounding air. This change assists in broadening the spray plume droplets to a wider region and in the formation and anchoring of stable combustion.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An atomizer configured to atomize liquids passed therethrough, the atomizer comprising:

an endcap comprising an annular wall extending longitudinally along an axial centerline of the atomizer from an upstream end to a downstream end with respect to a flow of fuel through the atomizer and a planar wall that extends radially inward from the downstream end of the annular wall to an opening;

a nozzle situated within the endcap; and a plurality of swirl vanes, wherein a first end radially outward end of each swirl vane in the plurality of swirl vanes contacts a radially inward surface of the annular wall, wherein each swirl vane in the plurality of swirl vanes extends radially inward from the radially inward surface of the annular wall towards the axial centerline of the atomizer and terminates at a radially inward end, wherein a downstream end of each swirl vane contacts an upstream surface of the planar wall wherein each swirl vane extends axially upstream from the upstream surface of the planar wall and terminates at an upstream end, and the radially inward end of each swirl vane in the plurality of swirl vanes and the upstream end of each swirl vane of the plurality of swirl vanes do not contact any surface, wherein the plurality of swirl vanes are set at a non-zero angle of incidence to the endcap, wherein the endcap extends farther radially inward from the annular wall than the swirl vanes extend radially inward from the annular wall, wherein the endcap defines an inner fluid chamber between a fluid inlet and the nozzle, wherein flow from the inlet to the nozzle is at least partially directed through passageways between the plurality of swirl vanes, and wherein the flow is imparted with swirling motion due to a tangential momentum imposed by the plurality of swirl vanes.

2. The atomizer of claim 1, wherein the nozzle is centered with respect to the endcap.

3. The atomizer of claim 1, wherein the angle of incidence is 32 degrees.

4. The atomizer of claim 1, wherein the plurality of swirl vanes extend radially inward from the radially inward inner surface of the annular wall at a 30 degree angle.

5. The atomizer of claim 1, wherein the tangential momentum is configured to increase a mixing between a plume sprayed from the endcap and air surrounding the plume.

6. An atomizer, comprising:

an endcap comprising an annular wall extending longitudinally along an axial centerline of the atomizer from an upstream end to a downstream end with respect to a flow of liquid through the atomizer and a planar wall that extends radially inward from the downstream end of the annular wall to an opening;

a spray nozzle situated within the endcap, wherein the spray nozzle is configured to pass the liquid through the spray nozzle; and a plurality of swirl vanes, wherein a radially outward end of each swirl vane in the plurality of swirl vanes contacts a radially inward surface of the annular wall, wherein each swirl vane in the plurality of swirl vanes extends radially inward from the radially inward surface of the annular wall towards the axial centerline of the atomizer and terminates at a radially inward end, wherein a downstream end of each swirl vane contacts an upstream surface of the planar wall, wherein each swirl vane extends axially upstream from the upstream surface of the planar wall and terminates at an upstream end, and the radially inward end of each swirl vane in the plurality of swirl vanes and the upstream end of each swirl vane of the plurality of swirl vanes do not contact any surface, wherein the plurality of swirl vanes are configured to define a plurality of swirled passages, wherein the endcap extends farther radially inward from the annular wall than the swirl vanes extend radially inward from the annular wall, wherein the plurality of swirled passages are configured to impart a swirling motion to gas passing through the plurality of swirled passages, and wherein the plurality of swirl vanes and the spray nozzle are configured to mix the liquid with the gas, thereby atomizing the liquid.

7. The atomizer of claim 6, wherein the plurality of swirl vanes comprise 8 swirl vanes.

8. The atomizer of claim 6, wherein the plurality of swirl vanes extend radially inward from the radially inward inner surface of the annular wall at a 30 degree angle.

9. The atomizer of claim 6, wherein the plurality of swirl vanes are configured to impose a tangential momentum on the gas passing through the plurality of swirled passages.

10. The atomizer of claim 6, wherein the plurality of swirl vanes are configured to impose a tangential momentum on the gas, and wherein the tangential momentum is configured to increase a mixing between a plume sprayed from the endcap and air surrounding the plume.

11. The atomizer of claim 6, wherein the nozzle is centered with respect to the endcap.

12. An atomizer, comprising:

an endcap comprising an annular wall extending longitudinally along an axial centerline of the atomizer from an upstream end to a downstream end with respect to a flow of liquid through the atomizer and a planar wall that extends radially inward from the downstream end of the annular wall to an opening;

a spray nozzle situated within the endcap, wherein the spray nozzle is configured to pass the liquid through the spray nozzle; and a plurality of swirl vanes, wherein a radially outward end of each swirl vane in the plurality of swirl vanes contacts a radially inward surface of the annular wall, wherein each swirl vane in the plurality of swirl vanes extends radially inward from the radially inward surface of the annular wall towards the axial centerline of the atomizer and terminates at a radially inward end, wherein a downstream end of each swirl vane contacts an upstream surface of the planar wall, wherein each swirl vane extends axially upstream from the upstream surface of the planar wall and terminates at an upstream end, and the radially inward end of each swirl vane in the plurality of swirl vanes and the upstream end of each swirl vane of the plurality of swirl vanes do not contact any surface, wherein the plurality of swirl vanes are configured to define a plurality of swirled passages, wherein the endcap extends farther radially inward from the annular wall than the swirl vanes extend radially inward from the annular wall, wherein the plurality of swirled passages are configured to impart a swirling motion to gas passing through the plurality of swirled passages, and wherein the plurality of swirl vanes and the spray nozzle are configured to mix the liquid with the gas, thereby atomizing the liquid, wherein the plurality of swirl vanes are configured to impose a tangential momentum on the gas passing through the plurality of swirled passages, and wherein the tangential momentum is configured to increase a mixing between a plume sprayed from the endcap and air surrounding the plume, wherein the nozzle is centered with respect to the endcap.

13. The atomizer of claim 12, wherein the plurality of swirl vanes comprise 8 swirl vanes.

14. The atomizer of claim 12, wherein the plurality of swirl vanes extend radially inward from the radially inward inner surface of the annular wall at a 30 degree angle.

15. The atomizer of claim 12, wherein the plurality of swirl vanes are set at a non-zero angle of incidence to the endcap.

16. The atomizer of claim 12, wherein the angle of incidence is 32 degrees.

* * * * *